United States Patent [19]

Cherot

[11] 4,405,053

[45] Sep. 20, 1983

[54] TAMPERPROOF CLOSURE SYSTEM FOR PLASTIC CONTAINERS

[75] Inventor: Harrison Cherot, McHenry, Ill.

[73] Assignee: Abbott Laboratories, North Chicago, Ill.

[21] Appl. No.: 258,191

[22] Filed: Apr. 27, 1981

[51] Int. Cl.[3] ..... B65D 1/02

[52] U.S. Cl. ..... 215/32; 215/331

[58] Field of Search ..... 215/32, 252

[56] References Cited

U.S. PATENT DOCUMENTS

| | | | |
|---|---|---|---|
| 2,214,255 | 9/1940 | Miner . | |
| 2,414,420 | 1/1947 | Sebell . | |
| 3,314,564 | 4/1967 | Andersen . | |
| 3,484,012 | 12/1969 | White et al. . | |
| 3,730,372 | 5/1973 | Komendowski | 215/32 |
| 3,804,282 | 4/1974 | Komendowski | 215/32 |
| 3,974,008 | 8/1976 | Choksi . | |
| 4,153,174 | 5/1979 | Keeler | 215/252 |
| 4,176,755 | 12/1979 | Winchell | 215/32 |

*Primary Examiner*—Donald F. Norton

*Attorney, Agent, or Firm*—Robert S. Beiser; Robert L. Niblack

[57] ABSTRACT

An improved tamperproof closure system for molded plastic containers has a threaded neck portion sealed at its distal end, and a screw-cap designed for attachment to the container neck. A flange extends radially from the container neck and a frangible annular groove is circumferentially disposed within the flange. A shoulder on the screw-cap is designed to press against the flange when the screw-cap is rotated downwardly on the neck. The force of the shoulder pressing against the flange ruptures the frangible annular groove, thereby severing the end portion of the container neck from the remainder of the neck, and retaining it within the screw-cap. A stop mechanism positioned in the threading of the container neck allows the screw-cap to be rotated downward to a point short of that necessary to rupture the frangible annular groove and yet far enough to securely attach the cap to the container. The stop mechanism also indicates when a container has been opened.

23 Claims, 8 Drawing Figures

TAMPERPROOF CLOSURE SYSTEM FOR PLASTIC CONTAINERS

BACKGROUND OF THE INVENTION

This invention relates, in general, to molded plastic containers and, in particular, to improved tamperproof closure systems for such containers. More particularly still, it relates to an improved sealed plastic container having a cap associated therewith which prevents inadvertent opening of the container and indicates when the container has been opened.

Various food, medical, and household products presently are being packaged in molded plastic containers. Presently, most of these containers are adapted to be easily opened. In particular, sealed molded plastic containers are used to dispense sterile medical liquids in various medical procedures. For example, one type of container, called an intravenous solution container, is used for the administration of parenteral solution into a patient's vein. Other types of medical liquid containers are used to dispense irrigating liquid to a surgical site.

All of these sterile medical liquid containers have a common purpose of maintaining the sterility of their liquid contents during storage, shipping and dispensing. An extremely critical portion of these containers is their closure system. The closure system must maintain a bacteria-tight seal until intentionally opened. Conversely, all of these closures must be easy for the nurse or physician to open.

One means of providing a bacteria-tight seal on a container closure is to make the closure an integral part of the container. This can be done by forming the container and closure as a one-piece unit, such as blow molding, or the closure can be fused or bonded to the container. To open the container, a frangible or separable portion of the closure or bottle is broken or torn. Examples of such closure systems may be found in U.S. Pat. Nos. 2,214,255; 2,414,420; 3,314,564; 3,484,012; 3,493,140; 3,974,008; and 4,153,174. Nevertheless, a continuing problem remains in such closure systems in preventing inadvertent opening, and in indicating when the container has been opened.

SUMMARY OF THE INVENTION

The present invention comprises an improved tamperproof closure system for sealed molded plastic containers. Specifically, the closure system comprises a screw-cap having internal threading constructed for engagement with threading of the container neck. A flange extends radially from the container neck and a frangible, annular groove is formed in and circumscribes the flange. A shoulder is disposed on the screw-type cap, preferably near the top portion, which is designed to engage against the flange when the cap is rotated downwardly onto the container neck. The force exerted by the shoulder against the flange ruptures the frangible, annular groove on the container neck and severs the end portion of the neck from the remainder. However, a stop mechanism positioned in the threading of the container neck, prevents inadvertent opening of the container by limiting the downward rotation of the screw cap. When opening is desired, the stop mechanism also allows the screw cap to pass beyond the limit point and to indicate thereby that the container has been opened.

In a preferred embodiment, the stop mechanism comprises a rib positioned within the threading of the container neck, usually close to the base of the neck. The rib is preferably integrally formed in the container neck; in a preferred embodiment, both the container and the stop mechanism are integrally formed in a blow molding operation. In such a blow molding operation, the container can be molded, the liquid filled in a sterile condition and the container sealed, commonly known as a blow-fill-seal operation. The rib is constructed to prevent rotation of the leading edge of the threading within the screw cap. In addition, the rib is designed to be displaced by the leading edge of the threading within the screw cap when the cap is forcefully rotated against the rib. As a result, inadvertent opening of the container is prevented and visual indication of the container having been opened is provided by the displaced position of the rib.

The rib usually comprises a vertical, rectangular appendage extending from between the first level of the threading on a container neck and the second level. The rib blocks passage of the leading edge of the threading on the screw cap so as to prevent further downward rotation of the cap. Preferably, the rib is at least one full helical turn from the distal or top end of the container neck so that the screw cap can be turned one full turn onto the neck, thereby assuring retention of the cap on the container. An additional means of insuring retention of the cap is the positioning of the number of locating nibs in the threading about the neck which prevent the cap from vibrating and thereby being loosened and shaken off the container during shipment.

An alternative construction of the stop mechanism comprises a lug within the threading which operates in substantially the same manner as a rib but is not elongated in shape. Similarly, a circular nib may be positioned in the threading to accomplish the same effect. In a preferred embodiment, the rib is severed by the leading edge of the screw cap threading when the cap is forceably rotated. As a result, when the cap has been opened, the severed condition of the rib indicates such opening. Similarly, the leading edge of the internal threading of the screw cap may be used to sever a lug or circular nib to accomplish the same purpose.

In an alternative embodiment, the rib, lug or circular nib may be attached to, rather than integrally formed from the molded container. For example, the rib may be staked or glued into the side of the container. The leading edge will then disengage the rib, lug or nib from the container, but essentially accomplish the same effect.

The flange mechanism previously described usually comprises an annular rim integrally formed and extending from the container neck. The annular rim has an outside diameter smaller than the inside diameter of the threading within the screw cap, but greater than the inside diameter of the shoulder mechanism disposed on the screw cap. As a result, the shoulder abuts and presses against the annular rim when the screw cap is threaded onto the container neck, causing the frangible annular groove to rupture. Alternatively, the flange may comprise two or more tabs integrally formed and extending radially from the container neck having a radial extension less than the inside diameter of the internal threading of the screw cap, but greater than the inside diameter of the shoulders of the screw cap. As a result, the shoulders abut and press against the tabs when the screw cap is threaded onto the container neck, causing the frangible, annular groove to rupture and the container to thereby be opened.

In a preferred embodiment, the shoulders comprise a circular bevel extending inwardly from the side walls of the screw cap near the top of the cap. As a result, the cap can be threaded onto the container neck until the circular bevel abuts against the flange previously mentioned. Further rotation of the cap causes the shoulder to press against the flange, rupturing the annular groove and opening the container. Usually, the top surface of the screw cap is co-extensive with the circular bevel and has an opening therethrough constructed and arranged for passage of the distal end of the container neck when the container is opened. Preferably, the sealed distal end of the container is substantially rounded and enlarged so as to be slightly larger than the inside diameter of the opening, but is sufficiently deformable to pass through the opening. The neck is then indented below the enlarged tip so as to press fit into and be retained by the opening in the screw cap following opening of the container.

In a preferred embodiment, the screw cap includes a membrane sealed across the opening which is rupturable or peelable from the top surface of the screw cap. As a result, when the closed distal end of the container displaces the membrane, a visual indication is provided that the container has been opened.

DETAILED DESCRIPTION OF THE PREFERRED EMBODIMENT

Figure 1:
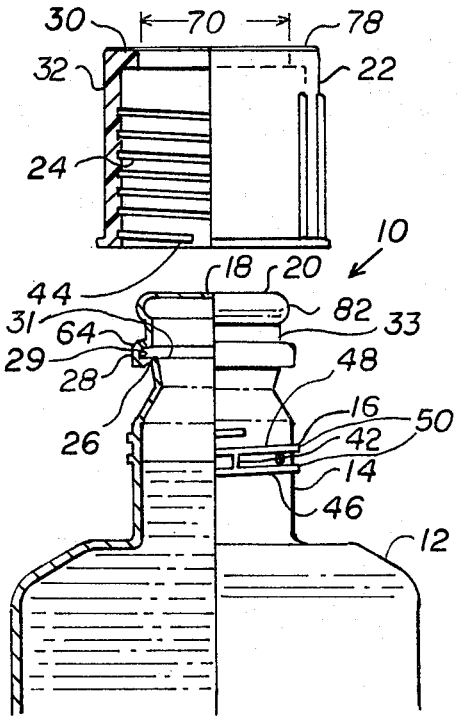
FIG. 1 of the drawings is a front view, partially broken away, of an improved tamperproof closure system.

While this invention is susceptible of embodiment in many different forms, there is shown in the drawings and will herein be described in detail several specific embodiments with the understanding that the embodiments illustrated are an exemplification of the principles of the invention, and are not intended to limit the invention to the embodiments illustrated.

As best seen in FIG. 1 of the drawings, improved tamperproof closure system 10 comprises a molded container 12 having a neck 14 extending vertically therefrom. Neck 14 has threading 16 integrally formed and helically disposed thereon. Neck 14 also has seal 18 at its distal end 20 which seals container neck 14 and thereby container 12. Closure system 10 also comprises screw cap 22 having a helical internal threading 24 integrally formed therein of the proper size and construction for rotatable engagement with threading 16 on container neck 14. A frangible, annular groove 26 is formed in and circumscribes flange 28, which extends radially from container neck 14. The groove is ruptured by means of rotation of screw cap 22 so as to allow access to container 12. However, until rupture, groove 26 provides a hermetic seal of container 12.

The mechanism by which groove 26 is ruptured includes flange 28. Shoulder 30 is integrally formed in screw cap 22 and extends inwardly from sidewall 32 of cap 22. When screwcap 22 is rotated downwardly on helical threads 24, shoulder 30 presses against annular flange 28, pressing downward and causing frangible groove 26 to rupture, thereby opening the container 12. The interior surface 29 of flange 28 accommodates lip 31 of container neck 14 following the downward movement of distal portion 33 of container neck 14.

Figure 2:
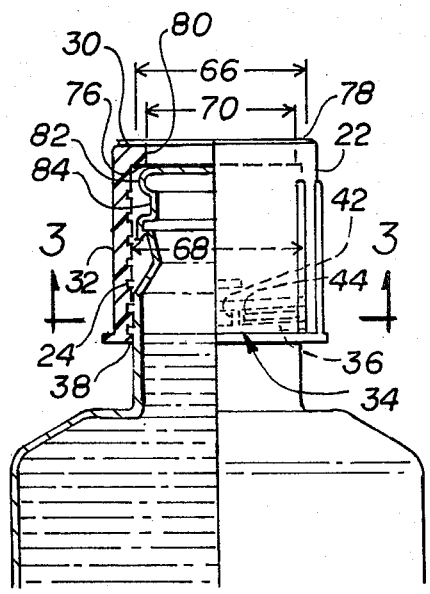
FIG. 2 of the drawings is a front view, partially broken away, of the closure system of claim 1, showing in particular a screw cap threaded onto the neck of a blow molded container with a stop mechanism stopping the cap from further rotation.
Figure 4:
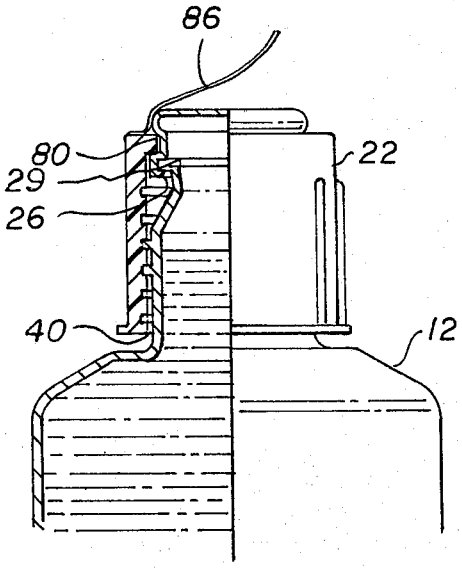
FIG. 4 of the drawings is a front view, partially broken away, of the closure system of FIGS. 1–3 showing in particular the screw cap having been rotated past the stop mechanism, thereby causing a frangible groove in the container neck to rupture, thereby opening the container.

A particularly unique feature of the invention is stop mechanism 34, best seen in FIG. 2 of the drawings. As best seen in FIG. 2, stop mechanism 34 is positioned near the proximal portion 36 of threading 16 helically disposed about container neck 14. Stop mechanism 34 prevents screw cap 22 from being inadvertently rotated downward to the point where frangible annular groove 26 is ruptured. The level 38 at which screw cap 22 may be rotated downwardly onto neck 14 is best seen in FIG. 2. As best seen in FIG. 4, when stop mechanism 34 is overriden, screw cap 22 is rotated downwardly to level 40 at which frangible annular groove 26 is ruptured.

Figure 5:
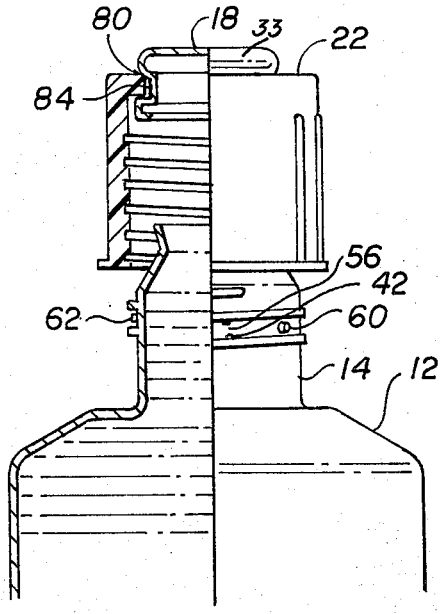
FIG. 5 of the drawings is a front view, partially broken away, of the closure system of FIGS. 1–4 showing in particular the top of the container neck and screw cap being removed from the container.

Returning to FIGS. 1 and 2, stop mechanism 34 preferably comprises a rib 42 positioned within the proximal portions 36 of threading 16 on container neck 14. Rib 42 is of the proper size and is constructed of a sufficiently strong material to prevent rotation of the leading edge 44 of internal threading 24 on screw cap 22 (past rib 22). As best seen in FIG. 2, leading edge 44 comes into abutment with rib member 42, thereby preventing further rotation of screw cap 22. However, as best seen in FIGS. 4 and 5, when screw cap 22 is forcefully rotated, leading edge 44 causes rib 42 to rupture so as to allow opening of container 12. Thus, rib 42 prevents inadvertent opening of container 12, but allows selective opening, and indicates, as best seen in FIG. 5, when container 12 has been opened by the displaced or ruptured condition of rib 42. Rib 42 is preferably integrally molded in container neck 14 of container 12.

As further seen in FIG. 1, rib 42 is shown as a vertical, rectangular appendage extending from between first level 46 and second level 48 of threading 16. As a result, passage of leading edge 44 through threading 16 is blocked at this point. Additionally, rib 42 is positioned at least one or more full helical turns 50 (a thread extending one full circumference about neck 14) of threading 16 from distal end 20 of neck 14 which permits threading of screw cap 22 onto neck threading 16 a sufficient distance to retain screw cap 22 thereon.

Figure 6:
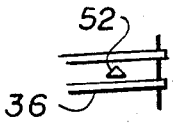
FIGS. 6 and 7 of the drawings are front views of alternative stop mechanisms which may be used in the container shown in FIGS. 1 and 2.
Figure 7:
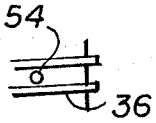
Figure 3:
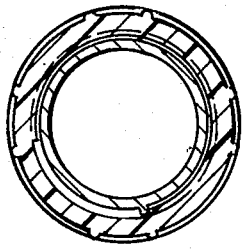
FIG. 3 of the drawings is a vertical section of the cap and container neck of FIG. 2 showing in particular the relative size of the cap, threading and container neck.

As best seen in FIGS. 6 and 7 of the drawings, stop mechanism 34 may alternatively comprise a lug 52 or a circular nib 54 positioned within proximal portion 36 of threading 16, which selectively prevents rotation of screw cap 22 past the leading edge 44 of threading 24, previously shown in FIG. 1.

As best seen in FIG. 5 of the drawings, in a preferred embodiment rib 42 is displaced by severing of a portion 56 thereof from container neck 14. However, alternatively, rib 42 may be staked (press fit into a hole) into threading 16 in which case it may be disengaged from container neck 14 by the rotation of screw cap 22. Similarly, lug 52 or circular nib 54 may be staked into container neck 14.

As an additional feature of the invention, one or more locating nibs (small raised bumps) such as nibs 60 and 62 are positioned within threads 16. Nibs 60 and 62 are small enough to allow passage of threading 24, but large enough to retard movement of threading 24 within threading 16 specifically, nibs 60 and 62 abut against and lightly engage the threading 24 of screw cap 22. As a result, inadvertent movement of cap 22 caused by vibration during shipment is prevented.

Returning to FIG. 1, flange 28 comprises an integrally formed annular rim 64 extending from container neck 14. As best seen in FIG. 2, annular rim 764 has an outside diameter 66 smaller than the inside diameter 68 of threading 24 within screw cap 22. However, the inside diameter 70 of shoulder 30 is less than the outside diameter 66 of annular rim 64. As a result, when screwcap 22 is rotated downwardly, shoulder 30 abuts and presses against annular rim 64, thereby causing frangible, annular groove 28 to rupture and container 12 to thereby be opened. Distal portion 33 of container neck 14 is then moved downwardly until interior surface 29 of flange 28 receives newly formed lip 31 of container 14.

Figure 8:
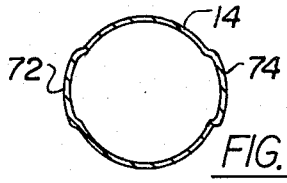
FIG. 8 of the drawings is a vertical section of an alternative embodiment of the neck of a blow molded container having tabs extending therefrom.

In an alternative embodiment of the invention, flange 28 may comprise flange 72 and 74, best seen in FIG. 8. Flanges 72 and 74 extend radially from container neck 14 and have a radial extension less than the inside diameter of threading 24 within cap 22. However, the radial extension of flanges 72 and 74 is greater than the inside diameter 70 of shoulder 30 within screwcap 22. As a result, similarly to FIG. 2, when screw cap 22 is rotated downwardly, shoulder 30 press against flanges 72 and 74, causing annular frangible groove 26 to rupture and container 12 can thereby be opened.

As shown in FIG. 2, shoulder 30 preferably comprises a circular collar 76 extending inwardly from sidewalls 32 and proximate top surface 78 of screwcap 22. Since circular collar 76 is close to the top surface 78, screw cap 22 may be rotated downwardly until substantially affixed to container neck 14. Preferably, circular collar 76 is co-extensive with top surface 78 and has an opening 80 extending therethrough. Opening 80 allows the passage of distal end 20 of container neck 14 when screwcap 22 is rotated downwardly to point 40 (the rupture point).

An additional feature of the invention, as seen in FIGS. 1-5, is distal end 20 of container neck 14 which has a substantially rounded enlarged tip 82 constructed of the proper size and material to deform and pass through opening 80 of screwcap 22 during opening of container 12. An indented neck portion 84 between rounded tip 82 and flange 28 is designed to be press-fit into and retained in opening 80 of screwcap 22 following opening of container 12. Thus, as best seen in FIG. 5, following opening of container 12, screwcap 22 and end portion 33 of container neck 14 may be removed from the container 12. End portion 33 is retained in cap 22 by necked in portion 84 being press-fit within opening 80.

As best seen in FIG. 4 of the drawings, screwcap 22 also includes a membrane 86 sealed across opening 80. Membrane 86 may be either rupturable or peelable from top surface 78 of screwcap 22. As a result, when enlarged tip 82 is forced through opening 80, membrane 86 is displaced, thereby visually indicating when container 12 has been opened. Conversely, when membrane 86 is sealed across opening 80, a dust cover is provided.

Container 12 may be constructed of conventional thermoplastic materials such as polypropylene, polyethylene, polyvinylchloride, polyethylene terephthalate, acrylonitrile butadiene styrene, acrylic, polytetrafluoroethylene, polycarbonate and other thermoplastics. Screw cap 22 may be constructed of any of the above, as well as thermosetting resins such as epoxy, urea, etc. Rib 42 may be constructed of the same material as container 12, or if separately attached, all the above alternative materials, as well as metals such as steel or aluminum.

OPERATION OF THE SYSTEM

To attach screw cap 22 to container 12, screw cap 22 is threadably rotated downward on container neck 14 until retarded by stop mechanism 34. Specifically, leading edge 44 of threading 24 in cap 22 moves through threading 16 on neck 14 until it is stopped by rib 42.

When opening of container 12 is desired, screw cap 22 is twisted forcefully, causing rib 42 to break. Cap 22 is then further rotated downward causing enlarged tip 82 to deform and pass through opening 80. Membrane 86 is thereby ruptured. Further downward rotation of cap 22 causes shoulder 30 to press against flange 28, and frangible groove 26 is thereby ruptured. Distal portion 33 of container neck 14 is then forced downwardly until interior surface 29 of flange 28 receives newly formed lip 31 of container neck 14. Distal portion 33 is then retained in cap 22 by means of shoulder 30 being press-fit within indent 34. Screw cap 22 and distal portion 33 may then be threadably removed from container 12.

The foregoing description and drawings will explain and illustrate the invention. The invention is not limited thereto, except insofar as the appended claims are limited to those skilled in the art who have the disclosure before them and are able to make modifications and variations therein without departing from the scope of the invention.

What is claimed is:

1. An improved tamperproof closure system for molded plastic containers having a threaded container neck sealed at its distal end, said closure system comprising:

a screw-type cap having internal threading constructed and arranged for threaded engagement with said container neck;

flange means integrally formed in and extending substantially radially from said container neck with a frangible annular groove circumferentially disposed about said flange means constructed and arranged to rupture when force is applied to said distal end of said container neck;

shoulder means disposed about said screw-type cap, constructed and arranged for abutment with said flange means whereby downward rotation of said screw cap is effective to rupture said frangible annular groove, and sever said distal portion of said container neck from the remainder thereof; and stop means positioned proximate said threads about said container neck, said stop means being constructed and arranged for selective limitation of the downward rotation of said screw cap onto said container neck to a point short of that required to rupture said frangible annular groove so as to prevent inadvertent opening of said container and to indicate when said container has been opened.

2. An improved tamper proof closure system for sterile medical liquid blow molded containers comprising:

a threaded container neck sealed at its distal end;

a screw type cap having internal threading constructed and arranged for threaded engagement with said container neck;

flange means extending radially from said container neck constructed and arranged for engagement with shoulder means disposed about said screw type cap;

a frangible annular groove circumferentially disposed about said flange means;

whereby downward rotation of said screw cap is effective to rupture said frangible annular groove, thereby severing said distal end portion of said container neck from the remainder thereof and retaining same within said screw cap;

the improvement comprising:

stop means positioned proximate said threads about said container neck, said stop means being constructed and arranged for selective limitation of the downward rotation of said screw cap onto said container neck to a point short of that required to rupture said frangible annular groove so as to prevent inadvertent opening of said container and to indicate when said container has been opened.

3. The closure system as disclosed by claim 1 or 2 wherein said container is blow molded, and said stop means is integrally formed thereon during molding.

4. The closure system as disclosed in claim 1 or 2 wherein said stop means comprises a rib member positioned within the threading of said container neck, constructed and arranged for selectively preventing rotation of the leading edge of said internal threading within said screw cap, said rib member further being constructed and arranged for displacement by said leading edge of said internal threading of said screw cap when said leading edge is forcefully rotated against said rib whereby inadvertent opening of said container is prevented and visual indication of said container having been opened is provided by the displaced condition of said rib member.

5. The closure system as disclosed in claim 4 wherein said rib member is integrally formed in said container neck of said molded container.

6. The closure system as disclosed in claim 4 wherein said rib member comprises a substantially vertical rectangular appendage extending from between a first lower level of said container neck threading and a second upper level of said container neck threading so as to block passage of said leading edge of said internal threading of said screw cap, thereby preventing further downward rotation thereof.

7. The closure system as defined in claim 4 wherein said rib member is positioned within said threading of said container neck one or more full helical turns of said threading from the distal end of said container neck so as to permit one full turn of said screw cap on said threading before being blocked by said stop means, thereby retaining said screw cap on said container neck.

8. The closure system as disclosed in claim 4 wherein said displacement comprises the severing of at least a portion of said rib member from said container neck.

9. The closure system as disclosed in claim 4 wherein said displacement comprises the disengagement of said rib member from said container neck.

10. The closure system as disclosed in claim 1 or 2 wherein said stop means comprises a lug member positioned within the threading of said container neck proximate the proximal portion of said threading, constructed and arranged for selectively preventing passage of the leading edge of the internal threading of said screw cap, said lug member further being constructed and arranged for displacement by said leading edge of said internal threading of said screw cap when said leading edge is forcefully rotated against said lug member, whereby inadvertent opening of said container is prevented and visual indication of said container having been opened is provided by the displaced condition of said lug member.

11. The closure system as disclosed in claim 10 wherein said displacement comprises the severing of at least a portion of said lug member from said container neck.

12. The closure system as disclosed in claim 10 wherein said displacement comprises the disengagement of said lug member from said container neck.

13. The closure system as disclosed in claim 1 or 2 wherein said stop means comprises a circular nib member positioned within the threading of said container neck proximate the proximal portion of said threading, constructed and arranged for selectively preventing passage of the leading edge of the internal threading of said screw cap, said circular nib member further being constructed and arranged for displacement by said leading edge of said internal threading of said screw cap when said leading edge is forcefully rotated against said circular nib member, whereby inadvertent opening of said container is prevented and visual indication of said container having been opened is provided by the displaced condition of said circular nib member.

14. The closure system as disclosed in claim 13 wherein said displacement comprises the severing of at least a portion of said circular nib member from said container neck.

15. The closure system as disclosed in claim 13 wherein said displacement comprises the disengagement of said nib member from said container neck.

16. The closure system as disclosed in claim 1 or 2 and further comprising one or more locating nibs positioned in said threads about said container neck constructed and arranged for abutting against said internal threads of said screw cap so as to prevent said screw cap from inadvertently vibrating off of said container neck during shipment.

17. The closure system as disclosed in claim 1 or 2 wherein said flange means comprises a substantially annular rim integrally formed and extending from said container neck, said annular rim having an outside diameter smaller than the inside diameter of said internal threading within said screw cap, but greater than the inside diameter of said shoulder means disposed about said screw cap whereby said shoulder means abuts and presses against said annular rim when said screw cap is threaded onto said container neck, thereby causing said frangible annular groove to rupture and said container to thereby be opened.

18. The closure system as disclosed in claim 1 or 2 wherein said flange means comprises two or more flanges integrally formed and extending radially from said container neck, said flanges having a radial extension less than the inside diameter of said internal threading within said screw cap but greater than the inside diameter of said shoulder means whereby said shoulder means abuts and presses against said flanges when said screw cap is threaded onto said container neck, thereby causing said frangible annular groove to rupture and said container to thereby be opened.

19. The closure system as disclosed in claim 1 or 2 wherein said shoulder means comprises a circular collar extending inwardly from the sidewalls of said screw cap proximate the top surface of said screw cap so as to permit the threading of said screw cap onto said container neck until said circular collar abuts said flange means.

20. The closure system as disclosed in claim 19 wherein said top surface of said screw cap is co-extensive with said circular collar, and has an opening therethrough constructed and arranged for passage of said closed distal end of said container neck when said screw cap is rotated downward to the point where said frangible annular groove is ruptured and said container is opened.

21. The closure system as disclosed in claim 20 wherein said distal end of said container neck has a substantially rounded, enlarged tip constructed and arranged to deform and pass through said opening in said screw cap during opening of said container, and an indented portion between said rounded tip and said flange means constructed and arranged to be press-fit into and retained in said opening of said screw cap following opening of said container.

22. The closure system as disclosed in claims 20 wherein said screw cap further includes a membrane sealed across said opening of said top surface of said screw cap, said membrane being alternatively rupturable or peelable from said top surface whereby passage of said closed distal end of said container neck through said opening in said screw cap is effective to displace said membrane thereby visibly indicating when said container has been opened.

23. An improved tamper proof closure system for blow molded containers having a threaded container neck sealed at its distal end, said closure system comprising:

a screw type cap having internal threading constructed and arranged for threaded engagement with said container neck;

flange means extending radially from said container neck constructed and arranged for engagement with shoulder means disposed about said screw type cap;

a frangible annular groove circumferentially disposed about said flange means, whereby downward rotation of said screw cap is effective to rupture said frangible annular groove, thereby severing said distal end portion of said container neck from the remainder thereof and retaining same within said screw cap; and stop means positioned proximate said threads about said container neck, said stop means being constructed and arranged for selective limitation of the downward rotation of said screw cap onto said container neck to a point short of that required to rupture said frangible annular groove so as to prevent inadvertent opening of said container and to indicate when said container has been opened.

* * * * *